US006506238B1

(12) United States Patent
Endo

(10) Patent No.: US 6,506,238 B1
(45) Date of Patent: Jan. 14, 2003

(54) ELECTRIC DUST COLLECTING UNIT

(75) Inventor: Kiyomu Endo, Tokyo (JP)

(73) Assignee: O-DEN Corporation, Tokyo (JP)

( * ) Notice: Subject to any disclaimer, the term of this patent is extended or adjusted under 35 U.S.C. 154(b) by 0 days.

(21) Appl. No.: 09/712,297

(22) Filed: Nov. 15, 2000

(30) Foreign Application Priority Data

Nov. 15, 1999 (JP) ..... 11-324717

(51) Int. Cl.[7] ..... B03C 3/08
(52) U.S. Cl. ..... 96/79; 96/87; 96/97
(58) Field of Search ..... 96/97, 100, 69, 96/77–79, 86, 87; 55/DIG. 38

(56) References Cited

U.S. PATENT DOCUMENTS

| | | | | |
|---|---|---|---|---|
| 3,765,154 A | * | 10/1973 | Hardt et al. | 55/DIG. 38 |
| 4,354,861 A | * | 10/1982 | Kalt | 96/69 |
| 5,401,301 A | * | 3/1995 | Schulmerich et al. | 55/DIG. 38 |
| 5,456,741 A | * | 10/1995 | Takahara et al. | 96/97 X |
| 5,582,632 A | * | 12/1996 | Nohr et al. | 96/69 X |
| 5,766,318 A | * | 6/1998 | Loreth et al. | 96/69 |
| 5,925,170 A | * | 7/1999 | Nojima | 96/100 X |
| 5,993,521 A | * | 11/1999 | Loreth et al. | 96/69 |
| 6,090,189 A | * | 7/2000 | Wikstrom et al. | 96/69 |
| 6,117,216 A | * | 9/2000 | Loreth | 96/100 X |

FOREIGN PATENT DOCUMENTS

| | | | | |
|---|---|---|---|---|
| JP | 48-94068 | | 12/1973 | |
| JP | 56-78645 | * | 6/1981 | 96/97 |
| JP | 63-22861 | * | 5/1988 | 96/97 |
| JP | 64-39815 | | 3/1989 | |
| JP | 2-117043 | | 9/1990 | |
| JP | 3-161059 | | 7/1991 | |
| JP | 4-98034 | | 3/1992 | |
| JP | 7-88399 | | 4/1995 | |
| JP | 2733908 | | 1/1998 | |
| JP | 36-16899 | | 9/1998 | |
| JP | 3092112 | | 7/2000 | |

OTHER PUBLICATIONS

Japanese Office Action dated Oct. 2, 2001 with partial English translation.

* cited by examiner

*Primary Examiner*—Richard L. Chiesa
(74) *Attorney, Agent, or Firm*—McGinn & Gibb, PLLC

(57) ABSTRACT

An electric dust collecting unit disclosed herein includes a corona discharging portion for giving rise to corona discharge to electrically charge cigarette smoke particulates, toner, and other floating particulates in air, an electric collecting portion disposed on a leeward side of this corona discharging portion, for electrically collecting the floating particulates charged at the corona discharging portion, and a box-type frame with its opposite surfaces opened, in such a configuration that the corona discharging portion has a plurality of needle electrodes which is disposed in such a way that their respective needle tips may be directed toward the leeward side (that is, with their backs directed toward a front face opening in the box-type frame).

10 Claims, 11 Drawing Sheets

ELECTRIC DUST COLLECTING UNIT

BACKGROUND OF THE INVENTION

1. Field of the Invention

The invention relates to an electric dust collecting unit and, more particularly to, the electric dust collecting unit suitable for use in a diesel engine exhausted carbon particulate removing apparatus, a factory oil mist removing apparatus or a like.

The present application claims priority of Japanese Patent Application No. Hei11-324717 filed on Nov. 15, 1999, which is hereby incorporated by reference.

2. Description of the Related Art

Since offices, restaurants, amusement places, factories, housing, and other buildings have recently been of an airtight construction, cigarette smoke, toner, welding fumes, and other harmful particulates floating in air are more likely to damage human health in a building, contaminated facilities and equipment. To guard against this, there has been widely employed an air cleaner which is placed in the office or housing, to collect cigarette smoke, particulates, and offensive odors floating in the air. One such type of air cleaner is known as a needle-discharge type air cleaner disclosed in Japanese Patent Application Laid-open No. Hei9-285739 (Japanese Patent No. 2733908), Japanese Patent Application No. Hei11-125451 (Japanese Patent No. 3092112), and others. This air cleaner roughly has such a configuration that, as shown in FIG. 8, its apparatus box body 3, having an air inlet 1 and an air outlet 2, includes a panel-shaped pre-filter 4, a box-shaped electric dust collecting unit 5, a panel-shaped deodorizing filter 6 made up of an activated carbon filter, and a ventilating fan 7, which are all mounted serially from a windward side to a leeward side therein.

In the above-mentioned configuration, when the ventilating fan 7 operates, air in a room is drawn in. If, in this case, the air in the room has been contaminated with cigarette smoke or other floating particulates, first the panel-shaped pre-filter 4 captures relatively large particulates, to permit other relatively small particulates that could not be captured by the panel-shaped pre-filter 4 to be captured and removed by the box-shaped electric dust collecting unit 5. Still remaining cigarette odor is absorbed and removed by the panel-shaped deodorizing filter 6. In this manner, cleaned air is returned to the room via the air outlet 2 by exhausting force of the ventilating fan 7. The boxed-shaped dust collecting unit 5 or a like, if contaminated with particulates or a like stuck thereto, may be taken out from the apparatus box body 3, washed, rehabilitated, and then mounted in the apparatus box body 3 again for use.

As shown in FIGS. 9 and 10, the boxed-shaped electric dust collecting unit 5 has a box-type frame 5*a* which includes a plurality of disk-needle-shaped needle electrodes 5*b*, prism-shaped deflecting electrodes 5*c* for supporting and fixing these disk-needle-shaped needle electrodes 5*b* in a protruded state, and both-ends-opened rectangular-shaped collector cells (collecting electrodes) (hereinafter may be referred to as collector cells 5*d*) for surrounding these disk-needle-shaped needle electrodes 5*b* and prism-shaped deflecting electrodes 5*c* in an non-contact manner which are all arrayed in a lattice and in combination in such a manner that there may be provided an air-passage gap between each of the prism-shaped deflecting electrodes 5*c* and its corresponding collector cell 5*d*.

When, in this configuration, a DC voltage of for example 5–6 V is applied between a disk-needle-shaped needle electrode 5*b* and its corresponding prism-shaped deflecting electrode 5*c*, which are both positive in potential, and its corresponding negative-potential electrode collector cell 5*d*, uniform corona discharge persistently occurs in a stable manner around the sharp tip of a disk-needle-shaped needle electrode 5*b*, thus forming an ionized space region 5*e* as shown in FIG. 11. When, in this state, the ventilating fan 7 operates to permit contaminated air inhaled via the air inlet 1 (FIG. 8) to reach the ionized space region 5*e* of the box-shaped dust collecting unit 5, oxygen is first dissociated into positive ions, which in turn stick to particulates p of cigarette smoke or a like and charge them electrically. The charged particulates "p" pass through between a next prism-shaped deflecting electrode 5*c* and its corresponding collector cell 5*d*, during which they are attracted to the collector cell 5*d* with a negative (lower) potential if they are near that collector cell 5*d*. If they are far away from a electrode plate(not shown or labeled) of the collector cell 5*d*, on an other hand, the particulates "p" are near the electrode plate (not shown or labeled) of the prism-shaped deflecting electrode 5*c* with a positive (higher) potential, so that they get Coulomb resiliency to move toward the electrode plate (not shown or labeled) of the collector cell 5*d*, thus finally being attracted and captured by the collector cell 5*d*.

In the above-mentioned prior art box-shaped electric dust collecting unit 5, however, as shown in FIGS. 9 and 10, the sharp tip of the disk-needle-shaped needle electrode 5*b* faces to an opened front face of the box-type frame 5*a*, therefore an operator may be injured by the needle electrodes when washing, maintaining or inspecting the boxed shaped electric dust collecting unit 5, thus holding a manufacturer responsible for handling safety.

SUMMARY OF THE INVENTION

In view of the above, it is an object of the invention to provide an electric dust collecting unit capable of safe replacement, washing, and maintenance and inspection.

According to a first aspect of the present invention, there is provided an electric dust collecting unit including:

a corona discharging portion for giving rise to corona discharge to thereby electrically charge floating particulates in an airflow; and an electric collecting portion disposed on a leeward side of the corona discharging portion, for electrically collecting the floating particulates charged at the corona discharging portion, wherein the corona discharging portion includes a plurality of needle electrodes in which each has a sharp needle tip and also which is arranged in such a way that the sharp needle tip thereof may be directed toward the leeward side.

In the foregoing, a preferable mode is one wherein the corona discharging portion and the electric collecting portion are disposed as separated from each other space-wise with or without an insulating material interposed therebetween.

Also, a preferable mode is one wherein the corona discharging portion includes:

the plurality of the needle electrodes which each has the sharp needle tip and also which is arranged in such the way that the sharp needle tip thereof may be directed toward the leeward side; and a plurality of opposing electrodes which is disposed in an n-to-one opposing relationship with the needle electrodes, where the n is a two or larger natural number representing number of the needle electrodes, and also which each has both ends thereof opened for forming an airflow passage.

Also, a preferable mode is one wherein the corona discharging portion includes:

the plurality of the needle electrodes which each has the sharp needle and also which is arrayed in such the way that the sharp needle tip thereof may be directed toward the leeward side; and a plurality of cell-shaped opposing electrodes which is disposed in a one-to-one opposing relationship with the sharp needle electrodes and also which each has both ends thereof opened for forming an airflow passage.

Also, a preferable mode is one wherein the corona discharging portion includes:

the plurality of the needle electrodes which each has the sharp needle tip and also which is disposed in such the way that the sharp needle tip thereof may be directed toward the leeward side;

one or more of supporting electrodes for supporting and fixing the plurality of the needle electrodes; and the plurality of the cell-shaped opposing electrodes which is disposed on a leeward side of the one or more supporting electrodes in the one-to-one opposing relationship with the needle electrodes and also which has the both ends thereof opened for forming the airflow passage.

Also, a preferable mode is one wherein each the needle electrodes are supported by the supporting electrodes with at least the sharp needle tip thereof as driven into an internal cavity of the cell-shaped opposing electrodes.

Also, a preferable mode is one wherein the one or more supporting electrodes are made of a rod-shaped member or an elongated member and has thereon the plurality of the needle electrodes supported and fixed in a row with a predetermined spacing therebetween.

Also, a preferable mode is one wherein the rod-shaped member or the elongated member of the one or more supporting electrode has a plurality of mounting holes made therein in a row with a predetermined spacing therebetween, each of which has corresponding one of the needle electrodes supported and fixed, as fitted therein.

Also, a preferable mode is one wherein the electric collecting portion includes:

a collecting electrode for electrostatically attracting and collecting floating particulates charged by the needle electrodes; and a deflecting electrode provided correspondingly to the collecting electrode, for providing the floating particulates which are charged, with deflecting force toward the collecting electrode.

Also, a preferable mode is one wherein the electric collecting portion has thereon the collecting electrode which is plate-shaped and the deflecting electrode which is plate-shaped as disposed in parallel with each other with a predetermined mounting spacing therebetween.

Also, a preferable mode is one wherein the opposing electrodes are made up of paper or synthetic resin coated with metal.

Also, a preferable mode is one wherein the opposing electrodes are made up of a stack of paper or synthetic resin and metal foil.

wherein the cell-shaped opposing electrodes are made up of paper or synthetic resin coated with metal.

Also, a preferable mode is one wherein the cell-shaped opposing electrodes are made up of a stack of paper or synthetic resin and metal foil.

Also, a preferable mode is one wherein at least one of the collecting electrode and the deflecting electrode is made up of paper or synthetic resin coated with metal.

Furthermore, a preferable mode is one wherein at least one of the collecting electrode and the deflecting electrode is made up of a stack of paper or synthetic resin and metal foil.

According to a second aspect of the present invention, there is provided an electric dust collecting unit including:

a corona discharging portion for giving rise to corona discharge to charge floating particulates in an airflow; and an electric collecting portion disposed on a leeward side of the corona discharging portion, for electrically collecting the floating particulates charged by the corona discharging portion, wherein:

the corona discharging portion includes a plurality of needle electrodes which each has a sharp needle tip and also which is disposed in such a way that the sharp needle tip thereof may be directed toward a leeward side, a plurality of rod-shaped or elongated supporting electrodes separately disposed from each other with a predetermined spacing therebetween, for supporting and fixing the plurality of the needle electrodes, and a plurality of cell-shaped opposing electrodes which is disposed on a leeward side of the plurality of rod-shaped or elongated supporting electrodes in a one-to-one opposing relationship with the needle electrodes and also which each has both ends thereof opened for forming airflow passage;

the electric collecting portion includes a plate-shaped collecting electrode for electrostatically attracting and collecting the floating particulates charged by the needle electrodes and a plate-shaped deflecting electrode provided correspondingly to the plate-shaped collecting electrode, for giving the floating particulates which are charged, deflecting force toward the plate-shaped collecting electrode, in such a configuration that the plate-shaped collecting electrode and the plate-shaped deflecting electrode are alternately disposed in parallel with each other with a predetermined spacing therebetween; and a mounting spacing between the plate-shaped collecting electrode and the plate-shaped deflecting electrode is set shorter than a mounting spacing between the plurality of rod-shaped or elongated supporting electrodes.

With the above configuration, the needle tip of each needle electrode is disposed and provided as directed toward the leeward side, in other words, with its back directed toward the front face opening in the electric dust collecting unit, so that the worker or the operator can be prevented from being injured his fingers or body by the needle tip, thus resulting in safe replacement, washing, and maintenance and inspection of the electric dust collecting unit. Therefore, the electric dust collecting unit of this embodiment is applicable not only to an office-use air cleaner but also to a home-use air cleaner.

In addition, since the prior art prism-shaped deflecting electrode is not used, airflow passage is not pressured, to thereby reduce pressure loss remarkably, thus contributing to miniaturization of the electric dust collecting unit, hence an air cleaner.

BRIEF DESCRIPTION OF THE DRAWINGS

The above and other objects, advantages and features of the present invention will be more apparent from the following description taken in conjunction with accompanying drawings in which.

DESCRIPTION OF THE PREFERRED EMBODIMENTS

Best modes of carrying out the present invention will be described in further detail using an embodiment with reference to the accompanying drawings.

First, overall configuration of an electric dust collecting unit is described as follows.

Figure 1:
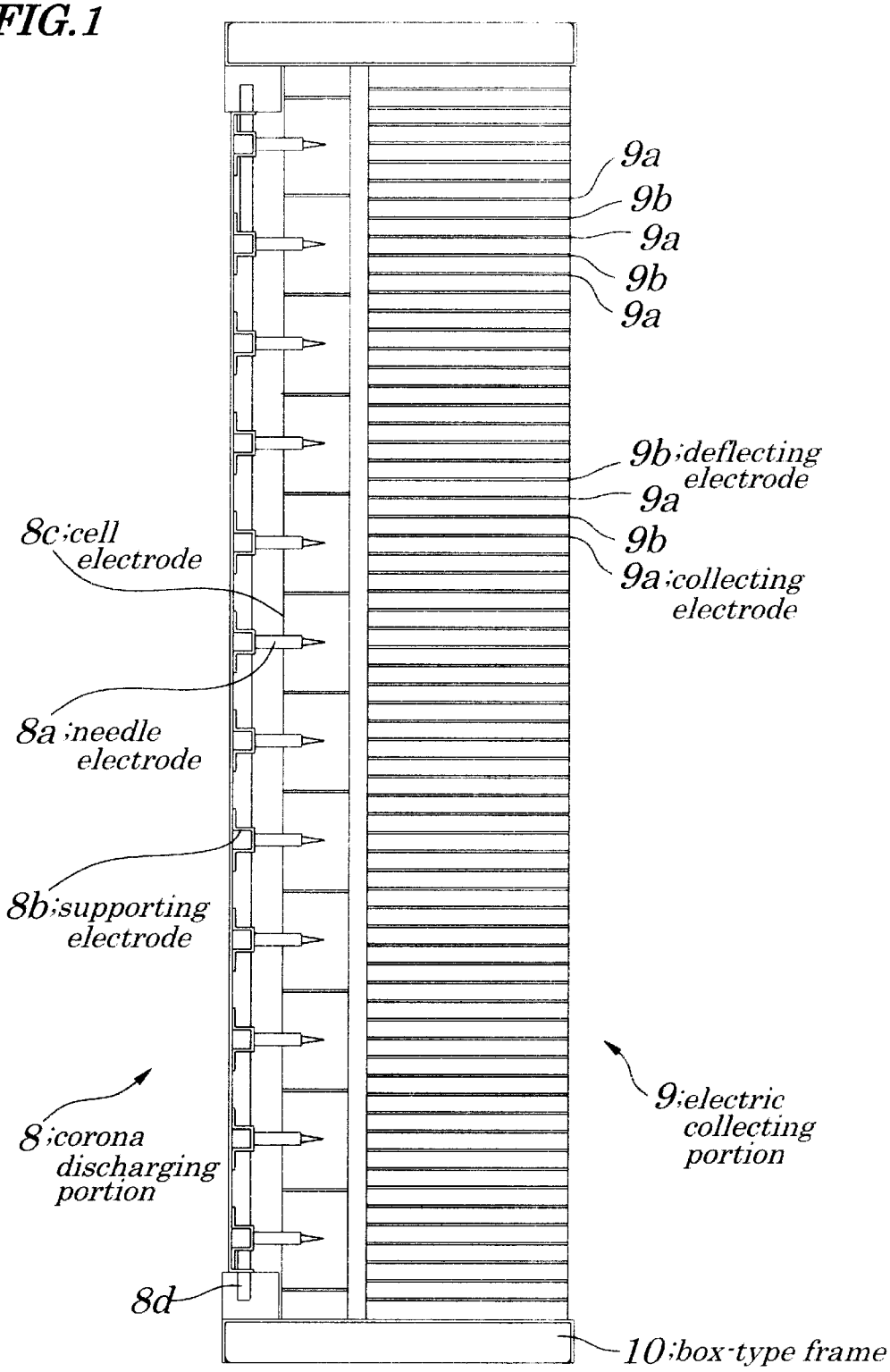
FIG. 1 is a vertical sectional view showing a rough configuration of an electric dust collecting unit according to an embodiment of the present invention.
Figure 2:
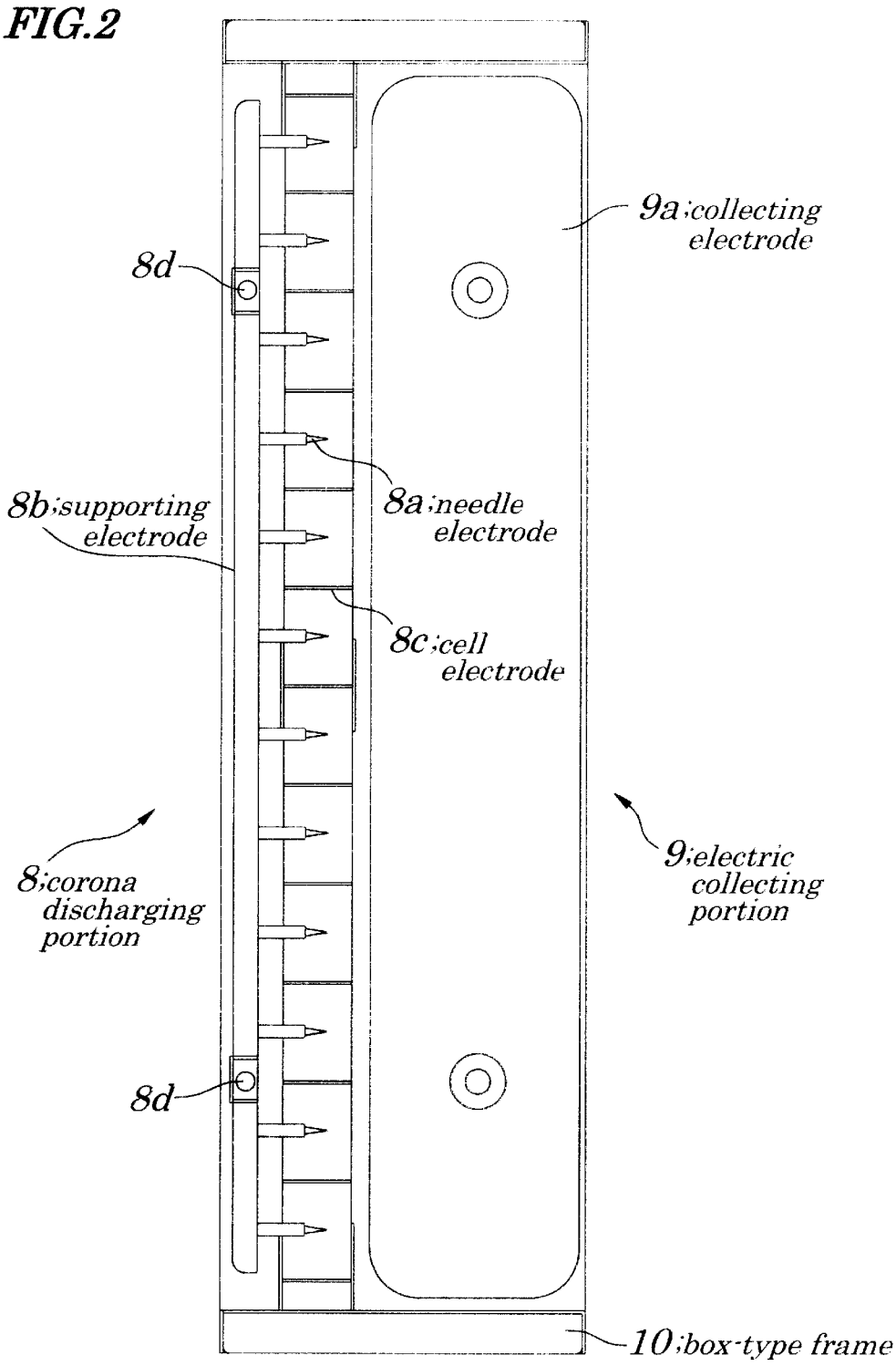
FIG. 2 is a horizontal sectional view showing the rough configuration of the electric dust collecting unit of FIG. 1.

As shown in FIGS. 1 and 2, the electric dust collecting unit according to this embodiment is comprised of a corona discharging portion 8 for giving rise to corona discharge to charge cigarette smoke particulates, toner, and other kinds of floating particulates floating in air, an electric collecting portion 9 disposed on a leeward side of this corona discharging portion 8, for electrically collecting the floating particulates charged at the corona discharging portion 8, and a box-type frame 10 with its front and rear faces opened, in such a configuration that the corona discharging portion 8 and the electric collecting portion 9 are housed in the box-type frame 10 and separated from each other by about 2–8 mm with no insulating material therebetween.

Next, the corona discharging portion 8 is described in detail.

As shown in FIGS. 1 and 2, the above-mentioned corona discharging portion 8 is comprised of a plurality of (12×12 in this case) needle electrodes 8*a* with their sharp needle tips arrayed vertically and horizontally toward the leeward side, a plurality of (12 in this case) rod-shaped supporting electrodes, supporting electrodes 8*b,* for supporting and fixing each row (12 vertically in this case) of the plurality of needle electrodes 8*a* with a predetermined spacing therebetween, and a plurality of (12×12 in this case) cell-shaped opposing electrodes (hereinafter referred to as cell electrodes 8*c,* which has each of their both ends opened for providing an air passage and which is disposed on the leeward side of these supporting electrodes 8*b* in a one-to-one opposing relationship with these needle electrodes 8*a.*

Figure 5A:
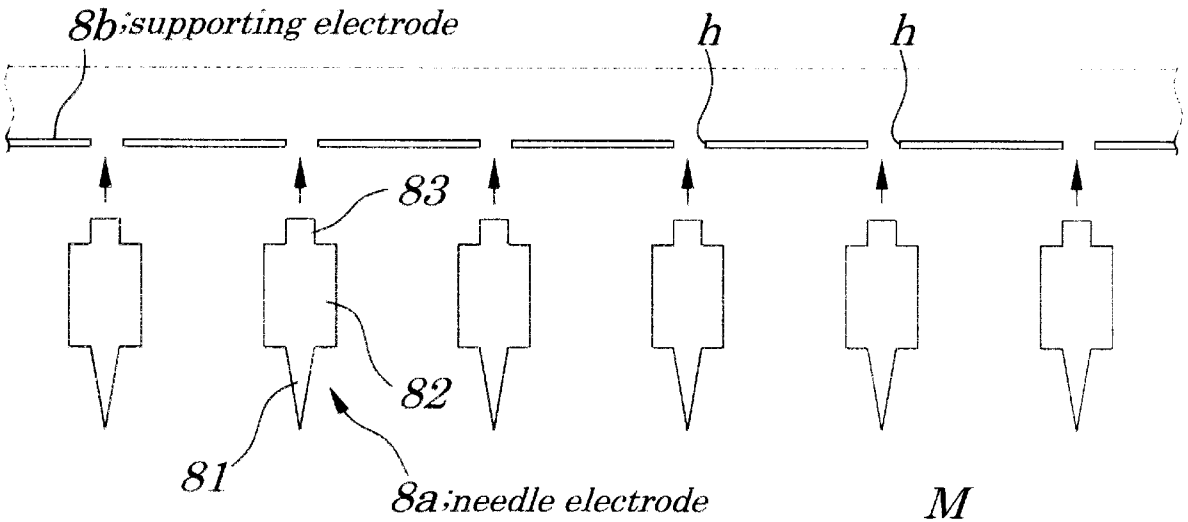
FIGS. 5A and 5B are flow diagrams explaining, along steps, how to attach needle electrodes of the electric dust collecting unit of FIG. 1.
Figure 5B:
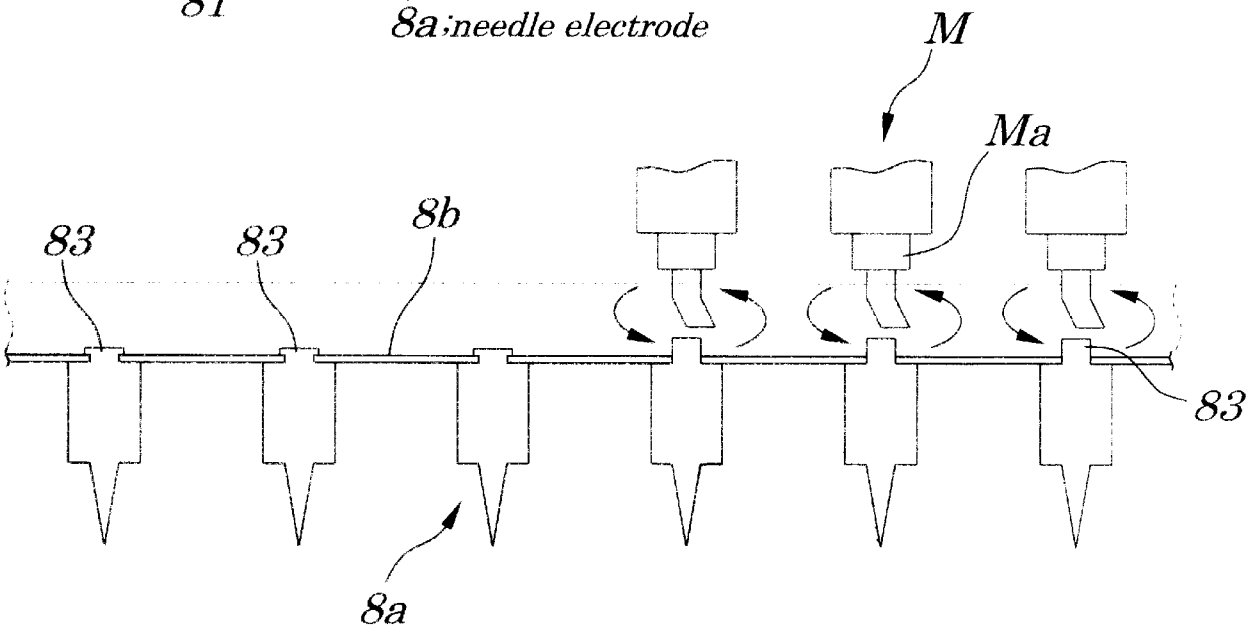

As shown in FIG. 5A and FIG. 5B, the needle electrodes 8*a* each is made up of a stainless-steel sharp needle tip, needle tip 81, plated with nickel (oxidation preventing treatment), a large-diameter cylindrical body portion, body portion 82, for supporting the needle tip 81, and a small-diameter cylindrical root portion 83 (having a step at a rear end portion), in such a manner that with the needle tip 81 as driven into its corresponding cell electrode 8*c* as deep as 2–12 mm as necessary, its root portion 83 is fixed by corresponding supporting electrode 8*b.* Note here that the needle electrode 8*a* according to this embodiment measures 5–20 mm in total length as necessary.

The above-mentioned supporting electrodes 8*b,* on an other hand, each have a U-shaped portion formed by folding an elongated metal plate flat plate into a cross-sectional U shape in section, as shown in FIG. 1, opposite sides of which are further folded back into respective flange portions. The supporting electrodes 8*b* have a plurality of (12 in this embodiment) mounting holes "h" made therein beforehand in a row with a predetermined spacing therebetween, which mounting holes "h" have a diameter a little larger than that of the root portion 83 of the needle electrode 8*a* and also into each of which mounting holes "h" is fit the needle electrode 8*a* to be supported and fixed thereto by use of caulking technologies. Note here that these mounting holes "h" are preferably made with a spacing of 10–30 mm therebetween and, more preferably, 15–25 mm from a viewpoint of dust collecting efficiency.

In this embodiment, to fix the needle electrode 8*a* to the supporting electrode 8*b,* first, as shown in FIG. 5A, the root portion 83 of the needle electrode 8*a* is inserted into the mounting hole "h" in the supporting electrode 8*b* and held there using a jig not shown. Next, as shown in FIG. 5B, an eccentric caulking tool Ma provided at a tip of a rotary shaft of a high-speed eccentric rotary caulking machine M is eccentrically rotated at a high speed as pressed against the root portion 83 of the needle electrode 8*a* which is protruded out upward from the mounting hole "h". As a result of this rotation, large eccentric force acts on the root portion 83 of the needle electrode 8*a* to caulk that root portion 83. After that, as shown on the left half of FIG. 5B, the root portion 83 is plastic-deformed (83') in a radial direction and integrated with the supporting electrode 8*b* solidly.

Figure 3:
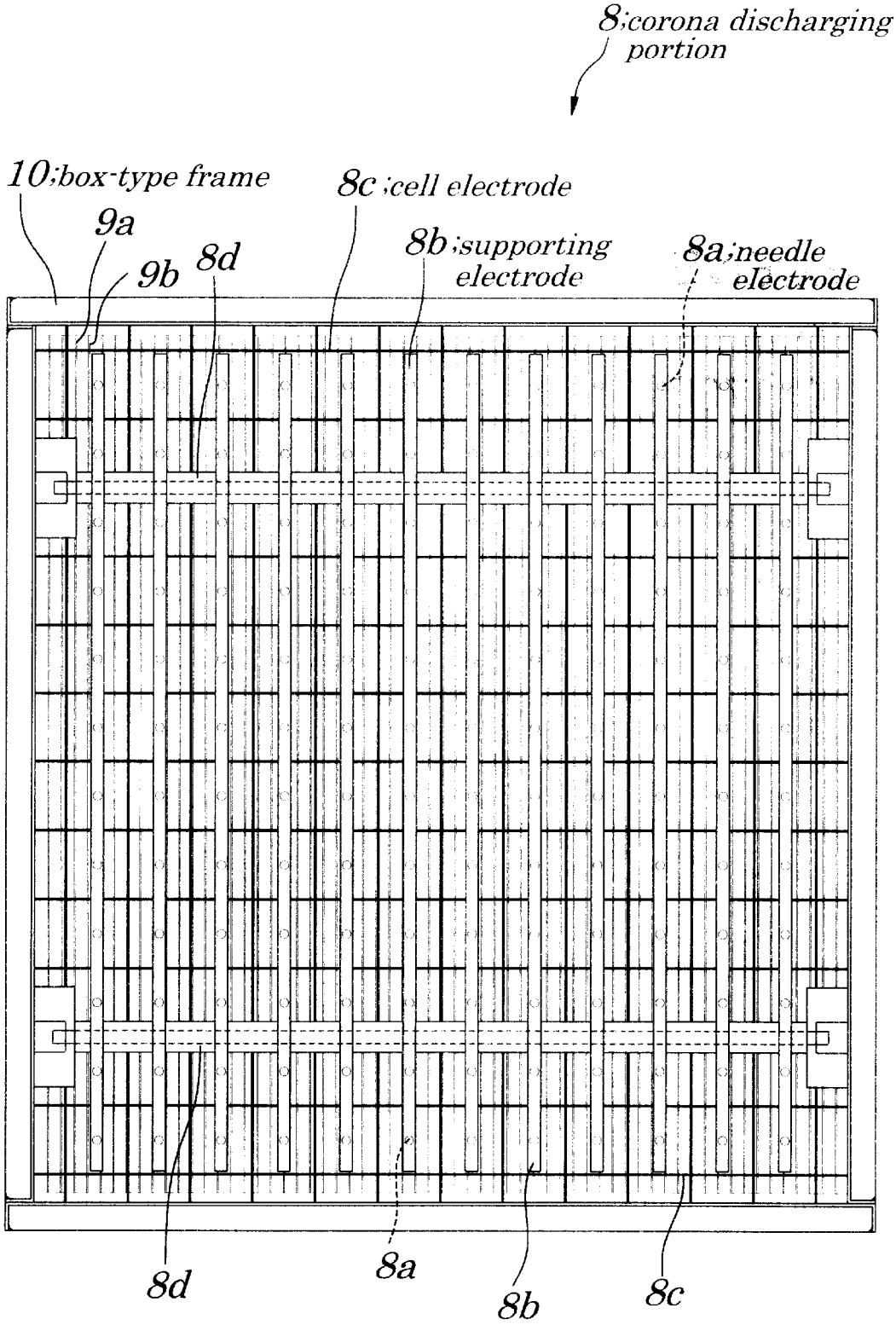
FIG. 3 is a front view (front elevation) showing the rough configuration of the electric dust collecting unit of FIG. 1.

In a side portion of each of the opposite ends of each supporting electrode 8*b* is made a through-hole (not lebeled) through which passes a coupling metal rod described later. In this embodiment, as shown in FIG. 3, twelve supporting electrodes 8*b* supporting the needle electrodes 8*a* are arrayed in parallel with each other with the predetermined spacing therebetween and spitted at their opposite ends by two coupling metal rods 8*d,* to be mutually coupled both mechanically and electrically.

Also, the cell electrodes 8*c* are formed into both-ends-opened square cells (cells measuring about 10–20 mm in depth for housing the needle tip 81 of the needle electrode 8*a*) by assembling vertically and horizontally a number of electrode flat plates measuring about 10–20 mm in width, into a one-to-one opposing relationship of electrodes arrayed in a lattice as a whole. Note here that each side of the cell electrode 8*c* is preferably 10–30 mm and, more preferably, 15–25 mm from a viewpoint of dust collecting efficiency.

Next, the electric collecting portion 9 is described in detail as follows.

Figure 4:
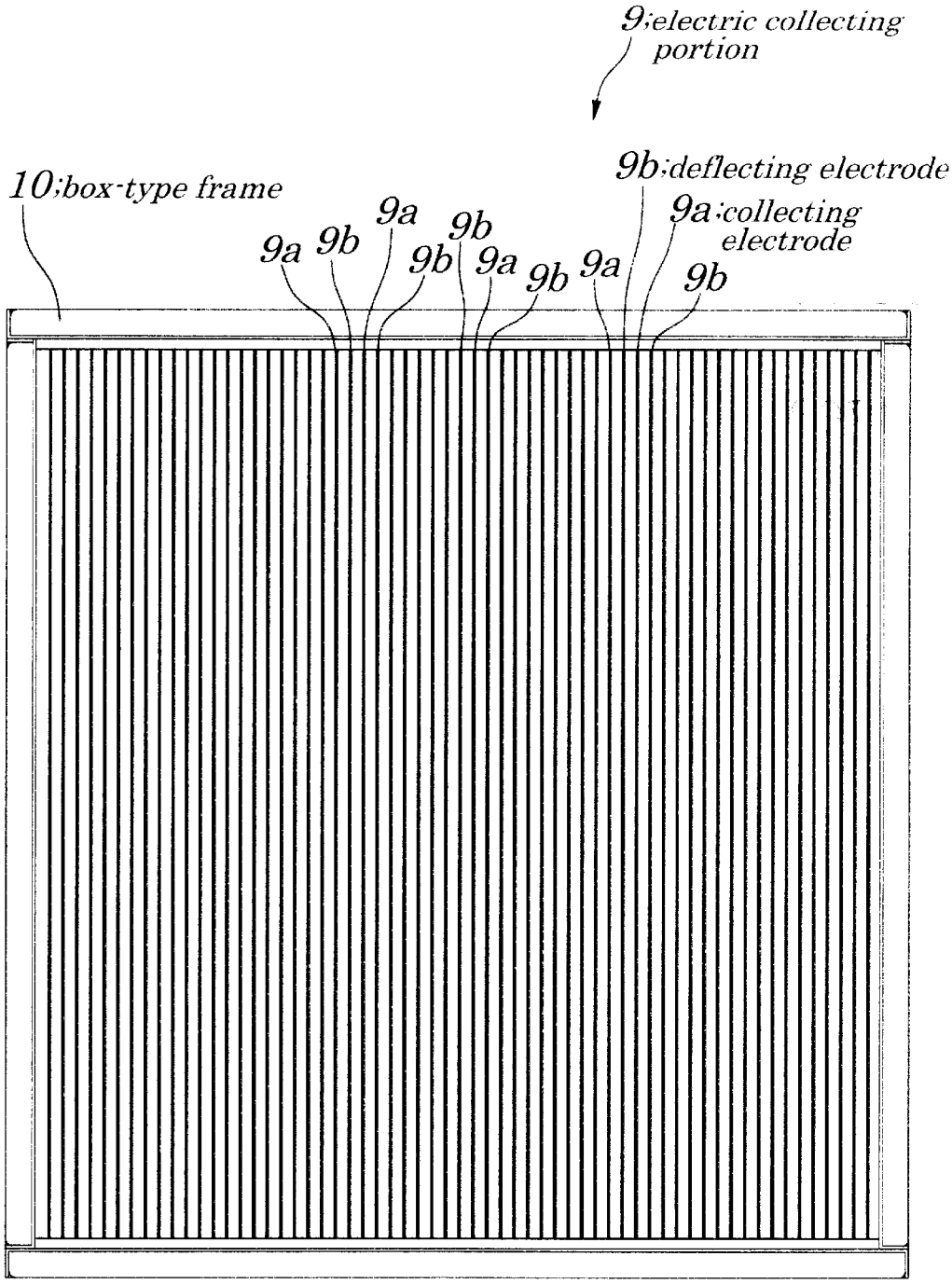
FIG. 4 is rear view (rear elevation, showing the rough configuration of the electric dust collecting unit of FIG. 1.

As shown in FIGS. 1 and 4, the electric collecting portion 9 has a plurality of collecting electrodes 9*a* each made up of a metal flat plate measuring 30–60 mm in width and deflecting electrodes 9*b* also each made up of a metal flat plate which are alternately disposed in parallel with each other with a mounting spacing of 3–8 mm therebetween in this embodiment. The collecting electrodes 9*a* have a function of attracting and collecting floating particulates charged by the needle electrodes 8*a*. The deflecting electrodes 9*b* have a role of providing the charged floating particulates which p ass by with deflecting force toward the collecting electrodes 9*a*.

As can be seen from the above-mentioned sizes, in this embodiment, mounting space between the collecting electrode 9*a* and the deflecting electrode 9*b* is set at a value smaller than that between the supporting electrodes 8*b*.

Next, with reference to FIG. 6, operations are described of a case where an electric dust collecting unit having the above-mentioned configuration is mounted in an air cleaner, as follows.

When the electric dust collecting unit is operating, at the corona discharging portion 8, a DC voltage of, for example, about 5 kV from a high tension DC power source is applied between the needle electrodes 8*a* and the cell electrodes 8*c* in such a wiring aspect that the needle electrodes 8*a* may be of a positive potential and the cell electrodes 8*c* may be of a negative or ground potential. Likewise, at the electric collecting portion 9, a DC voltage of, for example, about 5 kV from the high tension DC power source is applied between the collecting electrodes 9*a* and the deflecting electrodes 9*b* in such a wiring aspect that the deflecting electrodes 9*b* may be of a positive potential and the collecting electrodes 9*a* may be of a negative or ground potential. Note here that voltage is applied to the needle electrodes 8*a* via the corresponding supporting electrodes 8*b*.

Figure 6:
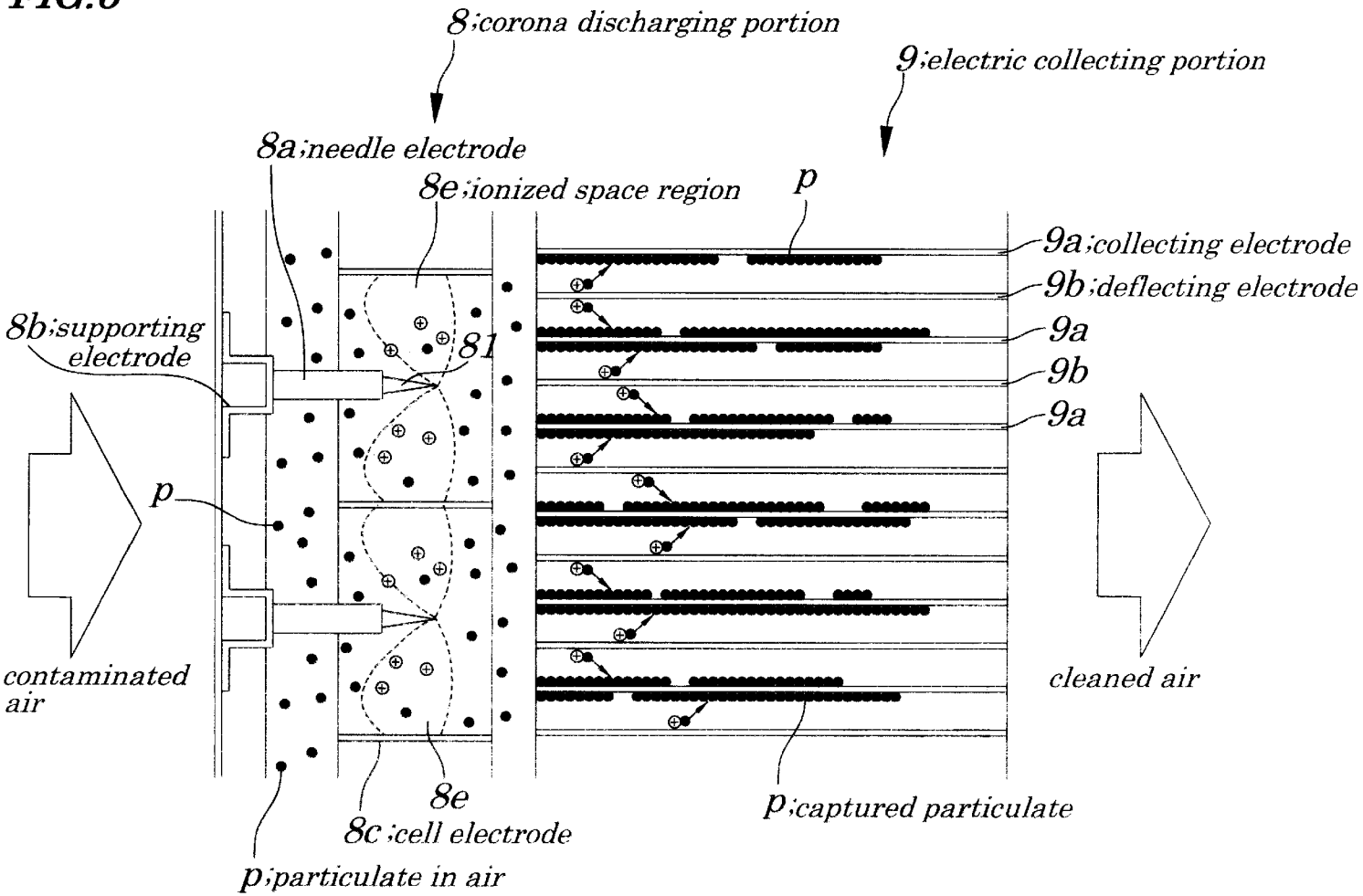
FIG. 6 explains operations of the electric dust collecting unit of FIG. 1 when it is attached to an air cleaner.
Figure 7:
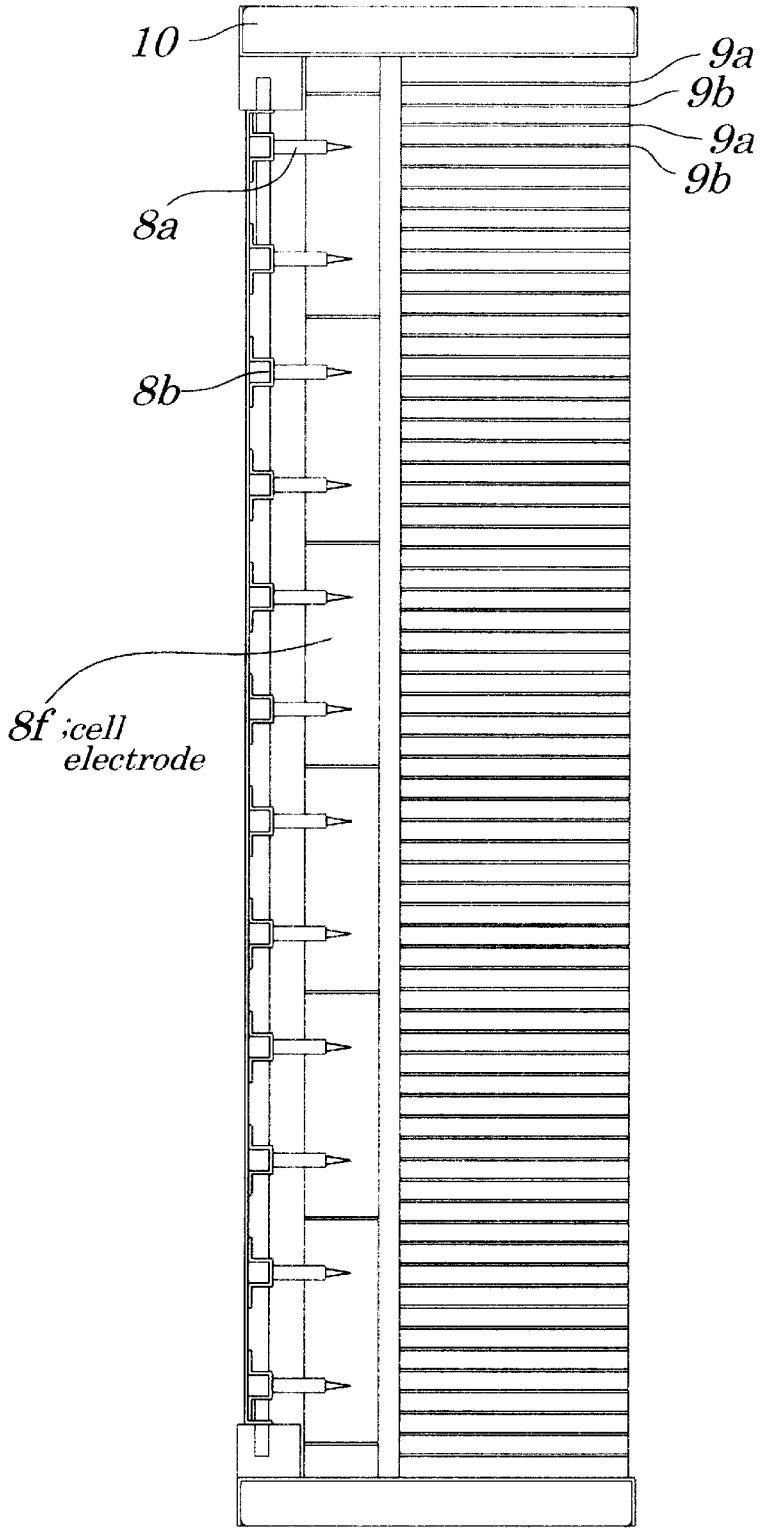
FIG. 7 is vertical sectional view showing a configuration of a variant according to the embodiment of FIG. 1.
Figure 8:
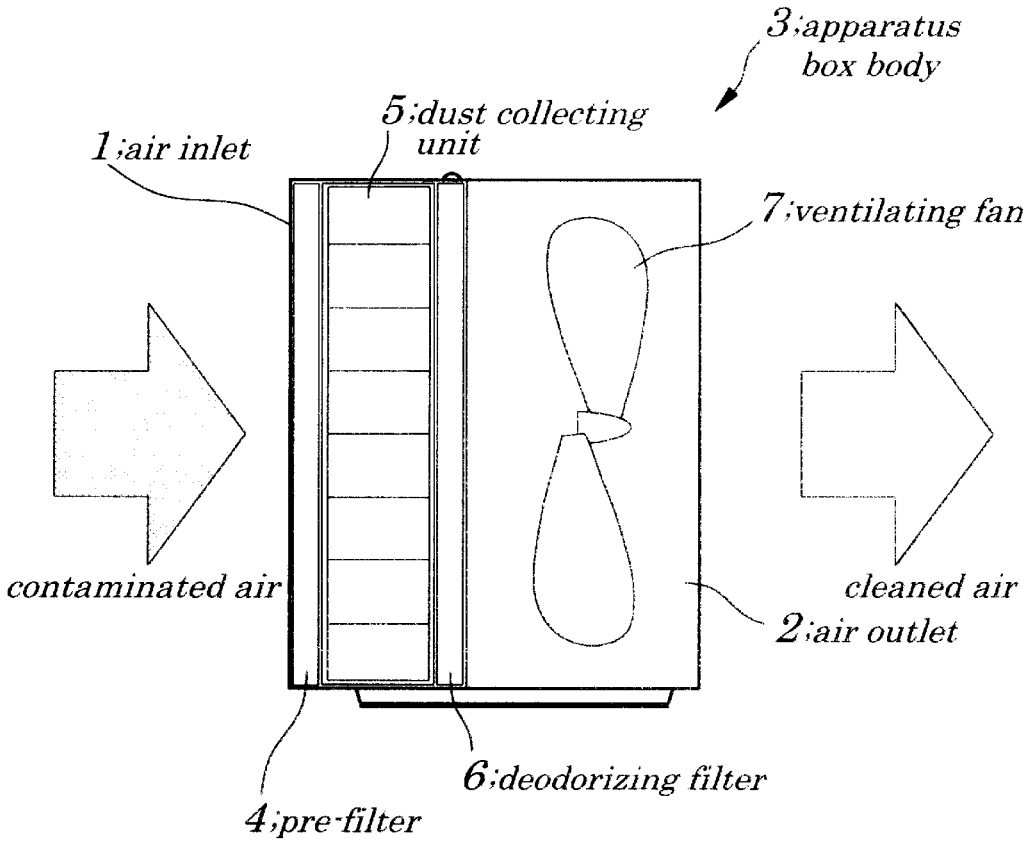
FIG.8 (PRIOR ART)
FIG. 8 is a schematic sectional view showing a rough. configuration of a prior art air cleaner.

In this state, at the corona discharging portion 8, as shown in FIG. 6, uniform corona discharge occurs persistently in a stable manner around the needle tip 81 of each of the needle electrodes 8*a*, to form an ionized space region 8*e*. with this, when contaminated air drawn in the electric dust collecting unit by attracting force of a ventilating fan (not shown) passes through the corona discharging portion 8 (ionized space region 8*e*), first the oxygen having lower ionizing energy is dissociated into positive ions, which in turn stick to, for example, cigarette smoke particulates "p" to give them electric charge of a positive ion. Thus charged particulates "p" pass through a next electric collecting portion 9 (between the collecting electrodes 9*a* and the deflecting electrodes 9*b*), during which those particulates are captured to the collecting electrodes 9*a* at negative or ground potential if they are near these collecting electrodes 9*a* and, if they are far away from the electrodes plates of the collecting electrodes 9*a*, they get resiliency due to the positive potential of the deflecting electrodes 9*b* to be pushed toward the electrode plates of and captured by the collecting electrodes 9*a*.

Air thus cleaned is returned again to a room by an exhausting force of the ventilating fan. The electric dust collecting unit, if contaminated with particulates or a like stuck thereto, is taken out of the electric dust collecting unit apparatus box body to be cleaned, rehabilitated, and then mounted again in that electric dust collecting unit apparatus box body for use.

Thus, according to the configuration of this embodiment, the needle tips 81 of the needle electrodes 8*a* are disposed and provided as directed toward the leeward side, in other words, with their backs directed toward the front face opening of the electric dust collecting unit, so that the worker and the operator can be prevented from being injured their fingers by the needle tip, resulting in safe replacement, washing, and maintenance and inspection of that electric dust collecting unit. Therefore, the electric dust collecting unit of this embodiment is applicable to an air cleaner not only for use in offices but also for use in houses at large.

Figure 9:
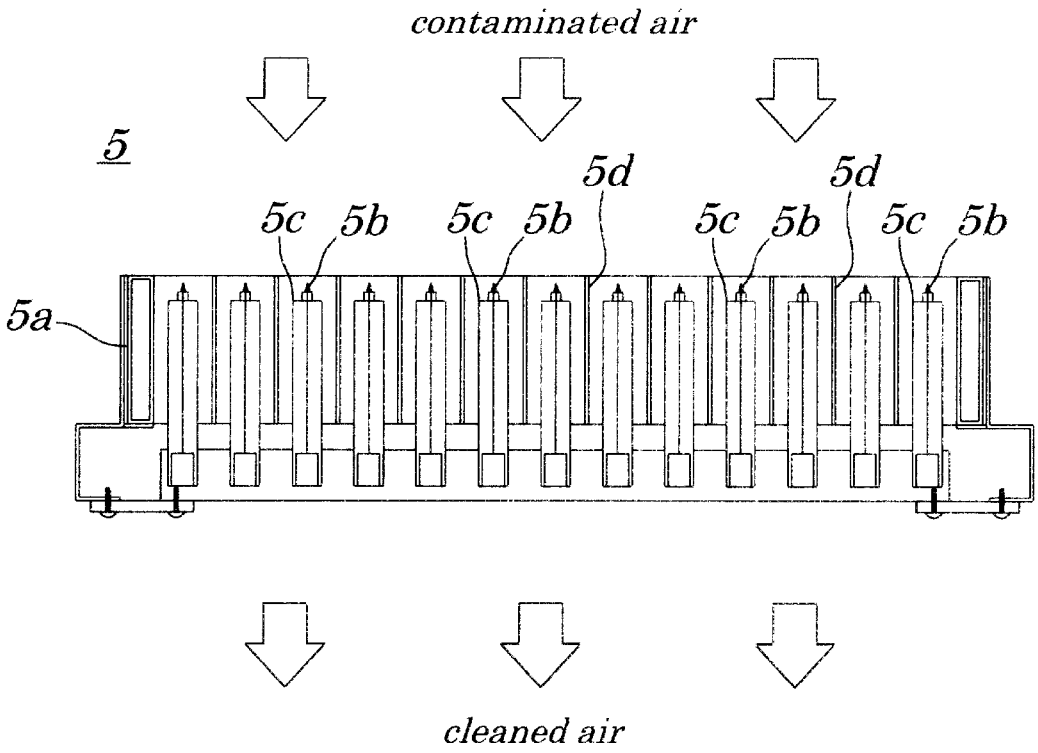
FIG.9 (PRIOR ART)
FIG. 9 is a cross-sectional view showing a configuration of a prior art needle discharge-type electric dust collecting unit.
Figure 10:
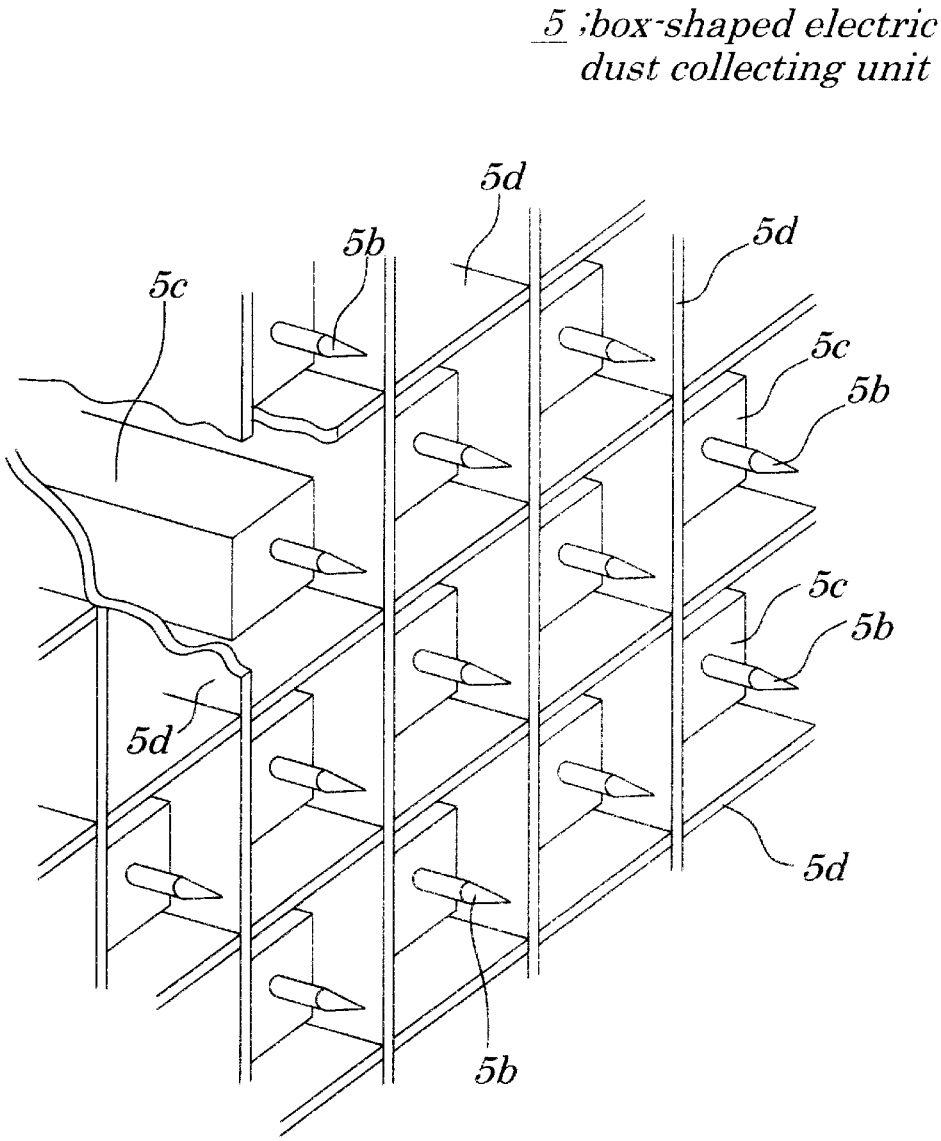
FIG. 10 (PRIOR ART)
FIG. 10 is an expanded perspective view showing an important part of the prior art needle discharge-type electric dust collecting unit of FIG. 9.
Figure 11:
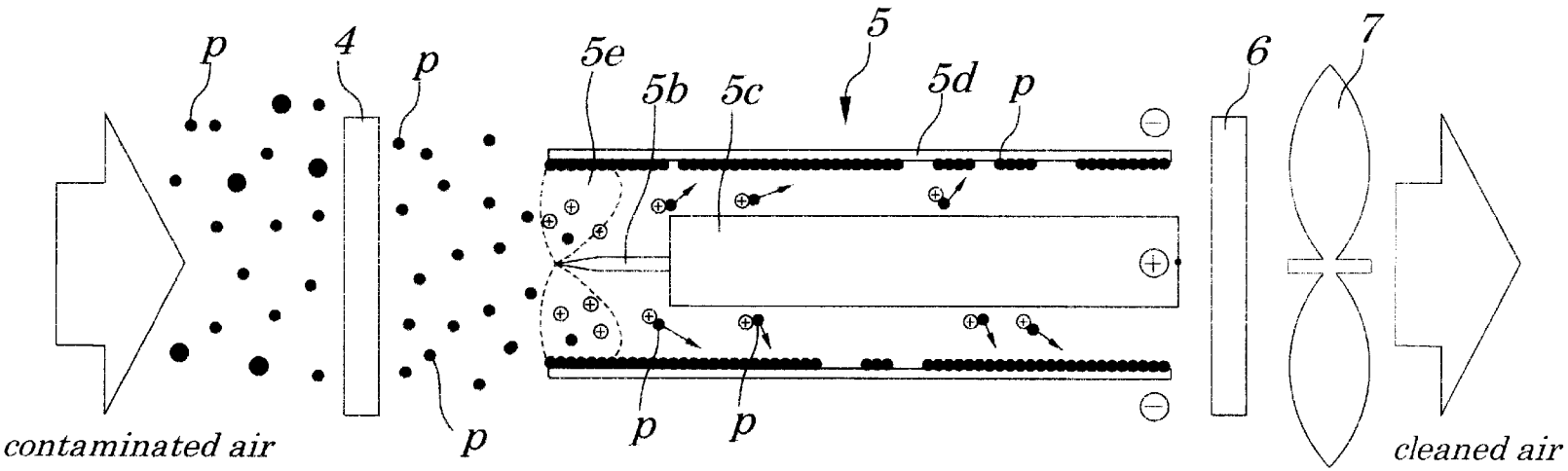
FIG. 11 (PRIOR ART)
FIG. 11 explains operations of the prior art needle discharge-type electric dust collecting unit of FIG. 9.

In addition, since it does not employ the prior art prism-shaped deflecting electrode 5*c* (see FIGS. 9 and 10), airflow passage is not pressured, to thereby remarkably reduce pressure loss, thus contributing to miniaturization of the electric dust collecting unit, hence the air cleaner.

It is apparent that the present invention is not limited to the above embodiments but may be changed and modified without departing from the scope and spirit of the invention.

For example, size, shape, number of articles, and layout of the needle electrodes 8*a*, the supporting electrodes 8*b*, the cell electrodes 8*c*, the collecting electrodes 9*a*, and the deflecting electrodes 9*b* are not limited to those of the above-mentioned embodiment but may be changed as necessary.

Also, although the above-mentioned embodiment has employed such a configuration that the corona discharging portion 8 and the electric collecting portion 9 are space-wise separated from each other by about 2–8 mm, this range of values is specifically disclosed only for convenience as a technological literature so it is not restrictive in the invention. Likewise, although length of each side of the cell electrode 8*c* is preferably 10–30 mm and, more preferably, 15–25 mm from the viewpoint of dust collecting efficiency, the invention is not limited to this range of values. Moreover, although the above-mentioned embodiment has set at 3–8 mm the mounting spacing between the collecting electrodes 9*a* and the corresponding deflecting electrodes 9*b*, the invention is not limited to this range of values. This holds true also with other ranges.

Further, although the above-mentioned embodiment has been described in the above embodiment where the plurality of needle electrodes 8*a* and the plurality of cell electrodes 8*c* are disposed in a one-to-one opposing relationship, such other layout may be employed that, for example, one cell electrode 8*f* may correspond to two needle electrodes 8*a*. Further, n (which is a two or larger natural number representing the number of the needle electrodes) number of needle electrode 8*a* may correspond to one opposing electrode. A term "opposing electrode" is used here because it is more appropriate than the a "cell electrode" when n is three or larger in a one-to-n opposing relationship between the cell electrodes 8*c* and the needle electrodes 8*a*. The opposing electrode may be groove-shaped or slit-shaped.

Also, although the above-mentioned embodiment has used caulking technology as means for fixing the needle electrodes 8*a* to the supporting electrodes 8*b*, the means is not limited to that, so that silver wax or any other appropriate adhesive agents may be used or the needle electrodes 8*a* may be driven into mounting holes made beforehand in the supporting electrodes 8*b* and fit thereto.

Further also, although the above-mentioned embodiment has been described in a case where the electric dust collecting unit of the invention is applied to an air cleaner, application is not limited to that, so that, for example, it may be applied to a diesel-engine exhausted-graphite removing apparatus, a factory oil-mist removing apparatus, or a like Further also, the cell electrodes (opposing electrodes), the collecting electrodes, or the deflecting electrodes may be made up of, besides a metal plate, paper or synthetic resin coated with metal or a stack made up of paper or synthetic resin and metal foil. With this, the electric dust collecting unit can be reduced in weight and manufacturing costs, thus improving recyclability.

Further also, although in the above-mentioned embodiment, the supporting electrode has been formed by folding part of the elongated metal flat plate into the cross-sectional U shape, a bulk-shaped member may be used instead.

Further also, the above-mentioned embodiment has been described in a case where the corona discharging portion and the electric collecting portion are space-wise separated from each other with no insulating material therebetween, instead an insulating material may be interposed therebetween to separate them from each other space-wise.

What is claimed is:

1. An electric dust collecting unit comprising:

a corona discharging portion for giving rise to corona discharge to thereby electrically charge floating particulates in an airflow; and an electric collecting portion disposed on a leeward side of said corona discharge portion, for electrically collecting said floating particulates charged at said corona discharging portion, wherein said corona discharging portion includes:

a plurality of needle electrodes in which each has a sharp needle tip and also which is disposed such that said sharp needle tip thereof is directed toward said leeward side, at least one supporting electrode for supporting and fixing said plurality of said needle electrodes, and a plurality of cell-shaped opposing electrodes which is disposed on a leeward side of said one or more supporting electrodes in a one-to-one opposing relationship with said needle electrodes and also which has said both ends thereof opened for forming said airflow passage, wherein said cell-shaped opposing electrodes are formed into both ends opened square or rectangular cells each having a depth for housing said needle tip of a corresponding one said needle electrode by assembling vertically and horizontally a number of electrode flat plates, and wherein said electric collecting portion includes a plate-shaped collecting electrode for electrostatically attracting and collecting said floating particulates charged by said needle electrodes and a plate-shaped deflecting electrode provided correspondingly to said plate-shaped collecting electrode, for giving said floating particulates which are charged, a deflecting force toward said plate-shaped collecting electrode, in such a configuration that said plate-shaped collecting electrode and said plate-shaped deflecting electrode are alternately disposed in parallel with each other with a predetermined spacing therebetween.

2. The electric dust collecting unit according to claim 1, wherein each said needle electrodes are supported by said supporting electrodes with at least said sharp needle tip thereof as driven into an internal cavity of said cell-shaped opposing electrodes.

3. The electric dust collecting unit according to claim 1, wherein said one or more supporting electrodes are made of a rod-shaped member or an elongated member and has thereon said plurality of said needle electrodes supported and fixed in a row with a predetermined spacing therebetween.

4. The electric dust collecting unit according to claim 3, wherein said rod-shaped member or said elongated member of said one or more supporting electrode has a plurality of mounting holes made therein in a row with a predetermined spacing therebetween, each of which has corresponding one of said needle electrodes supported and fixed, as fitted therein.

5. The electric dust collecting unit according to claim 1, wherein said plurality of cell-shaped opposing electrodes are made up of paper or synthetic resin coated with metal.

6. The electric dust collecting unit according to claim 1, wherein said plurality of cell-shaped opposing electrodes are made up of a stack of paper or synthetic resin and metal foil.

7. The electric dust collecting unit according to claim 1, wherein at least one of said collecting electrode and said deflecting electrode is made up of paper or synthetic resin coated with metal.

8. The electric dust collecting unit according to claim 1, wherein at least one of said collecting electrode and said deflecting electrode is made up of a stack of paper or synthetic resin and metal foil.

9. The electric dust collecting unit according to claim 1, wherein said electric collecting portion disposed on a leeward side of the corona discharge portion is non-pressurized.

10. The electric dust collecting unit according to claim 1, wherein said corona discharge portion and said electric collecting portion have a gap there between.

* * * * *